US006523187B1

(12) United States Patent
Brink et al.

(10) Patent No.: US 6,523,187 B1
(45) Date of Patent: Feb. 25, 2003

(54) LINER APPARATUS FOR TOILET SEAT

(76) Inventors: Kevin R. Brink, 223 E. Bellevue Ave., San Mateo, CA (US) 94401; Rosa Brink, 223 E. Bellevue Ave., San Mateo, CA (US) 94401

( * ) Notice: Subject to any disclaimer, the term of this patent is extended or adjusted under 35 U.S.C. 154(b) by 0 days.

(21) Appl. No.: 09/974,172

(22) Filed: Oct. 10, 2001

(51) Int. Cl.[7] ..... A47K 11/06
(52) U.S. Cl. ..... 4/484; 383/37
(58) Field of Search ..... 4/484, 451, 452; 383/37; 220/495.07

(56) References Cited

U.S. PATENT DOCUMENTS

| | | | | | |
|---|---|---|---|---|---|
| 1,978,871 | A | * | 10/1934 | Thuren | 4/484 |
| 2,067,958 | A | * | 1/1937 | Wallace | 4/484 |
| 3,061,840 | A | * | 11/1962 | Presseisen | 4/451 X |
| 4,136,798 | A | | 1/1979 | Oberstein | |
| 4,759,086 | A | | 7/1988 | Booth-Cox | |
| 4,882,794 | A | | 11/1989 | Stewart, III | |
| 4,996,727 | A | | 3/1991 | Wyatt | |
| 5,199,795 | A | * | 4/1993 | Russo et al. | 383/113 |
| 5,265,285 | A | | 11/1993 | Loebbert | |
| D354,342 | S | | 1/1995 | Marshall-Smith | |
| 5,455,972 | A | * | 10/1995 | Williams | 4/484 X |
| D381,070 | S | | 7/1997 | Deniakis et al. | |
| 5,903,932 | A | | 5/1999 | Whitesel | |
| 6,102,239 | A | * | 8/2000 | Wien | 220/495.07 |
| 6,115,855 | A | | 9/2000 | Lorenzo | |

* cited by examiner

*Primary Examiner*—Charles E. Phillips
(74) *Attorney, Agent, or Firm*—Dale J. Ream

(57) ABSTRACT

A liner apparatus for use with a toilet seat includes a base having a configuration complementary to that of a toilet seat for resting thereon. A plurality of bags compressed one atop the other are removably attached to one another and to the base. The base defines an outwardly extending planar flange. Each bag includes an upper edge defining an open top and includes a closed bottom that extends downward through a central opening of a toilet seat. A closed bottom of each bag includes an impervious outer layer, a permeable inner layer, and an absorbent layer having sodium polyacrylate crystals sandwiched between absorbent cellulosic fibrous material. Each bag includes a flexible tab removably attached to a next lower bag or to the base flange, each tab having a perforated construction such that a selected bag may be torn away after use.

4 Claims, 4 Drawing Sheets

LINER APPARATUS FOR TOILET SEAT

BACKGROUND OF THE INVENTION

The present invention relates generally to disposable waste containment devices and, more particularly, to a plurality of disposable toilet seat liners that are easy to position on a toilet seat and are highly absorbent.

Toilet training is often a frustrating and discouraging aspect of child rearing. Adding to the basic task of teaching a child to use a potty chair is the dreaded duty of cleaning the potty chair basin after each use. Various devices and disposable liners have been proposed for simplifying or eliminating this repetitive cleaning step. Although assumably effective for their intended purposes, existing liners are not conveniently changeable and do not provide sufficient absorption characteristics.

Therefore, it is desirable to have a plurality of compressed liners for use with a toilet seat such as a toddler potty chair that rests conveniently on the potty seat without any elastic members. Further, it is desirable to have liners that include perforated tabs which allow individual liners to be removed and disposed of while leaving the next liner already in position for use.

SUMMARY OF THE INVENTION

A liner apparatus according to the present invention includes a base having a configuration complementary to that of a toilet seat such as a child potty chair. The base includes a planar configuration that rests atop a toilet seat and defines a central opening. A pair of oppositely disposed flanges extend radially outwardly from the base. The liner apparatus includes a plurality of flexible bags compressed together in a stacked configuration. The bags are connected to the base, each bag defining an open top adjacent the base and a closed bottom extending downwardly through a central opening through the base. Each bag also includes a pair of flexible tabs coupled to respective flanges in a perforated construction such that a top-most bag can be torn away from the remaining bags for disposal. This leaves the next bag in position for use. Each bag includes an impervious outer layer, a permeable inner layer, and an absorbent layer between the inner and outer layers. The absorbent layer includes sodium polyacrylate crystals sandwiched between two layers of absorbent cellulosic fibrous material. The tabs may be tied together for bag closure prior to disposal.

Therefore, a general object of this invention is to provide a liner apparatus that is easy and stable to position upon a toilet or toddler potty chair seat.

Another object of this invention is to provide a liner apparatus, as aforesaid, in which each bag includes closure tabs which may be tied together to prevent spillage prior to disposal.

Still another object of this invention is to provide a liner apparatus, as aforesaid, which provides a clean and sanitary environment for toddlers.

Yet another object of this invention is to provide a liner apparatus, as aforesaid, which includes sodium polyacrylate crystals for enhanced absorption of human waste.

A further object of this invention is to provide a liner apparatus, as aforesaid, having a plurality of bags each with a pleated construction for expanding as waste is absorbed.

A still further object of this invention is to provide a liner apparatus, as aforesaid, having a plurality of bags with perforated tabs such that a top-most bag may be torn away from remaining bags, leaving the remaining bags in position for use.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
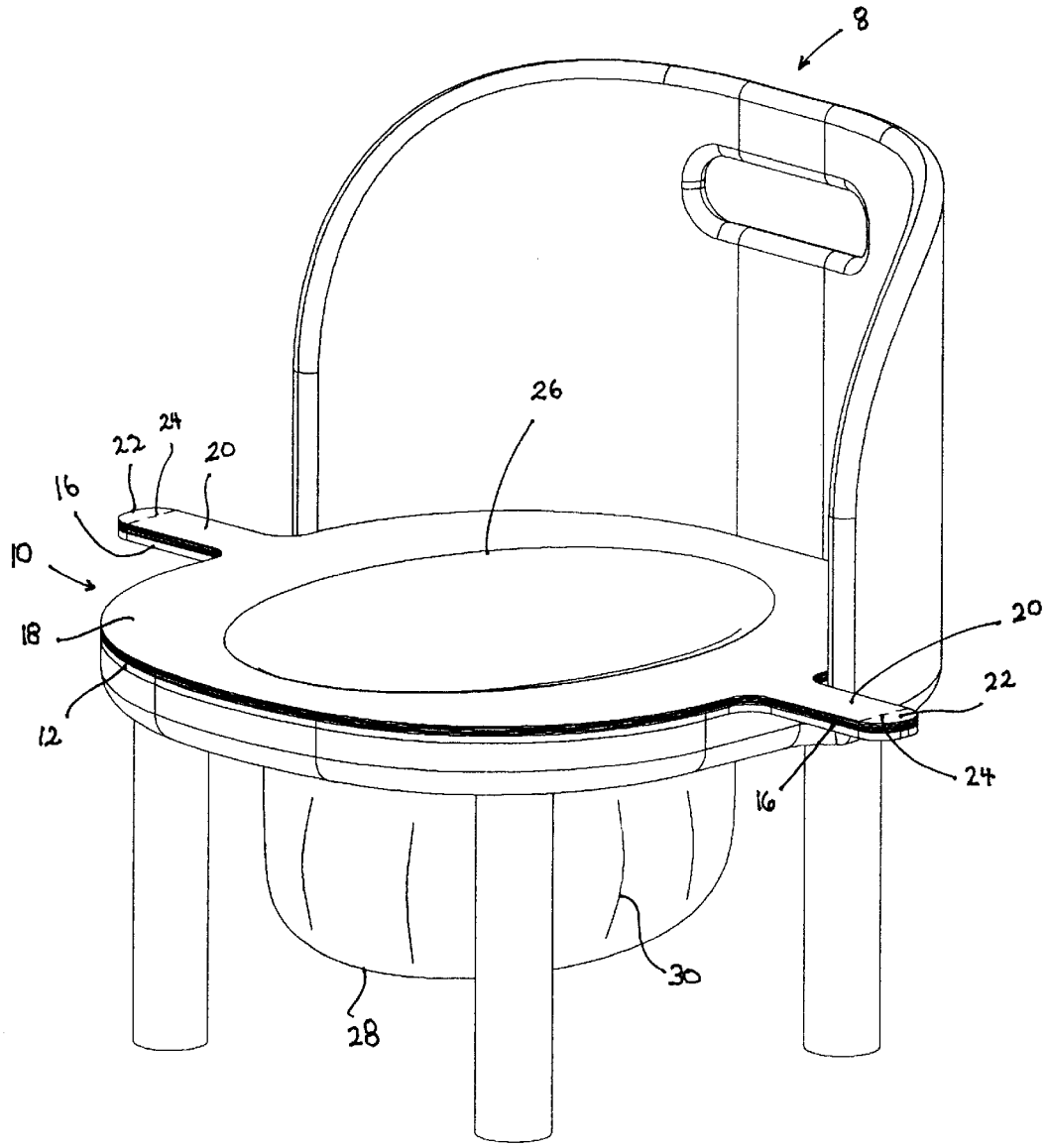
FIG. 1 is a perspective view of a liner apparatus in use with a toddler potty chair according to a preferred embodiment of the present invention.
Figure 2:
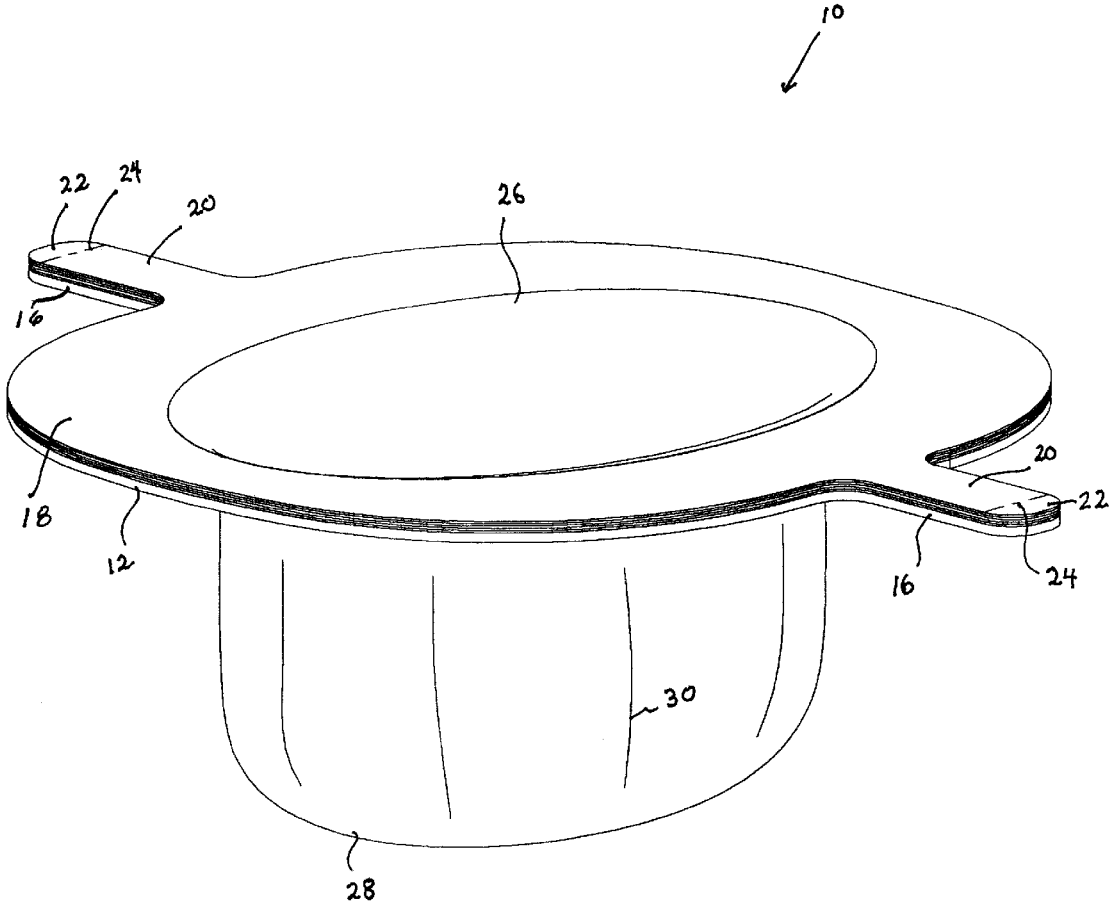
FIG. 2 is a perspective view of the liner apparatus as in FIG. 1 on an enlarged scale with the potty chair removed.

A potty liner apparatus 10 according to a preferred embodiment of the present invention will now be described with reference to FIGS. 1 through 5 of the accompanying drawings. The liner apparatus 10 includes a base 12 having a solid construction of a semi-rigid material such as cardboard although any suitable form of compressed board would work (FIG. 2). The base 12 presents an annular configuration defining a central opening therethrough. The base 12 includes a generally planar configuration that is complementary to the configuration of a toilet seat and, specifically, to the seat of a toddler potty chair 8. Therefore, the base 12 is configured to rest atop a toilet seat having a similar configuration so that the central opening registers with the conventional toilet seat opening or open top of a potty seat (FIG. 1).

A pair of oppositely disposed flanges 16 extend radially outwardly from an outer peripheral edge of the base 12 and are integrally connected thereto (FIG. 2). The flanges 16 also include flat constructions that extend outward of a toilet seat when the base 12 is positioned thereon. Thus, the flanges 16 may be used as handles for properly positioning the liner apparatus 10 for use.

The liner apparatus 10 includes a plurality of liner bags 18, each bag being constructed of a flexible plastic material that is impervious and leak proof. Preferably, the plurality of bags 18 are stacked and compressed together and connected to the base 12. Each bag 18 includes a configuration substantially similar to the configuration of the base 12, including a central opening. Although a plurality of bags connected together and to the base in a stacked relationship is preferred, it is understood that a single bag connected to the base 12 would also be suitable as a single use disposable liner apparatus.

Figure 3:
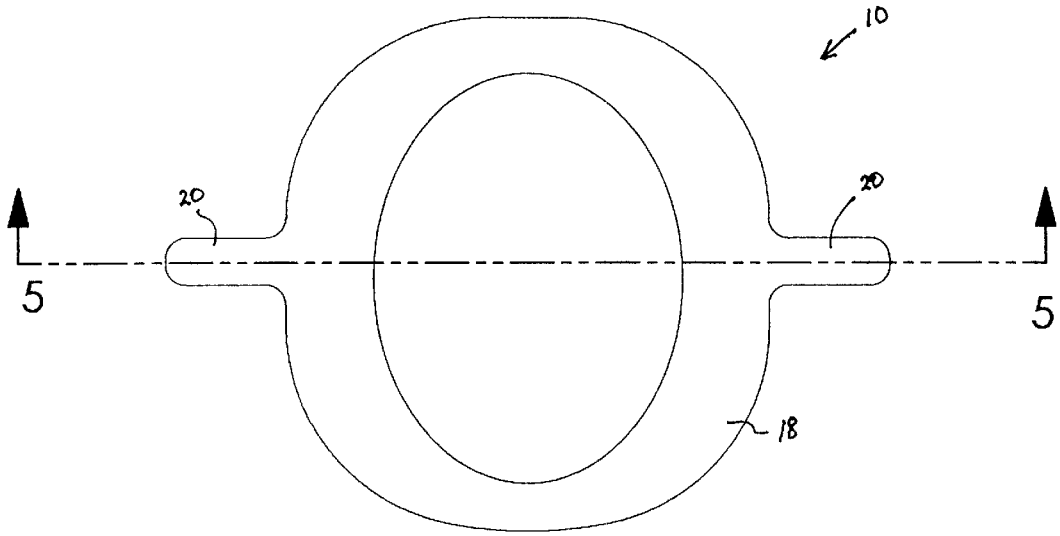
FIG. 3 is a top view of the liner apparatus as in FIG. 2.
Figure 4:
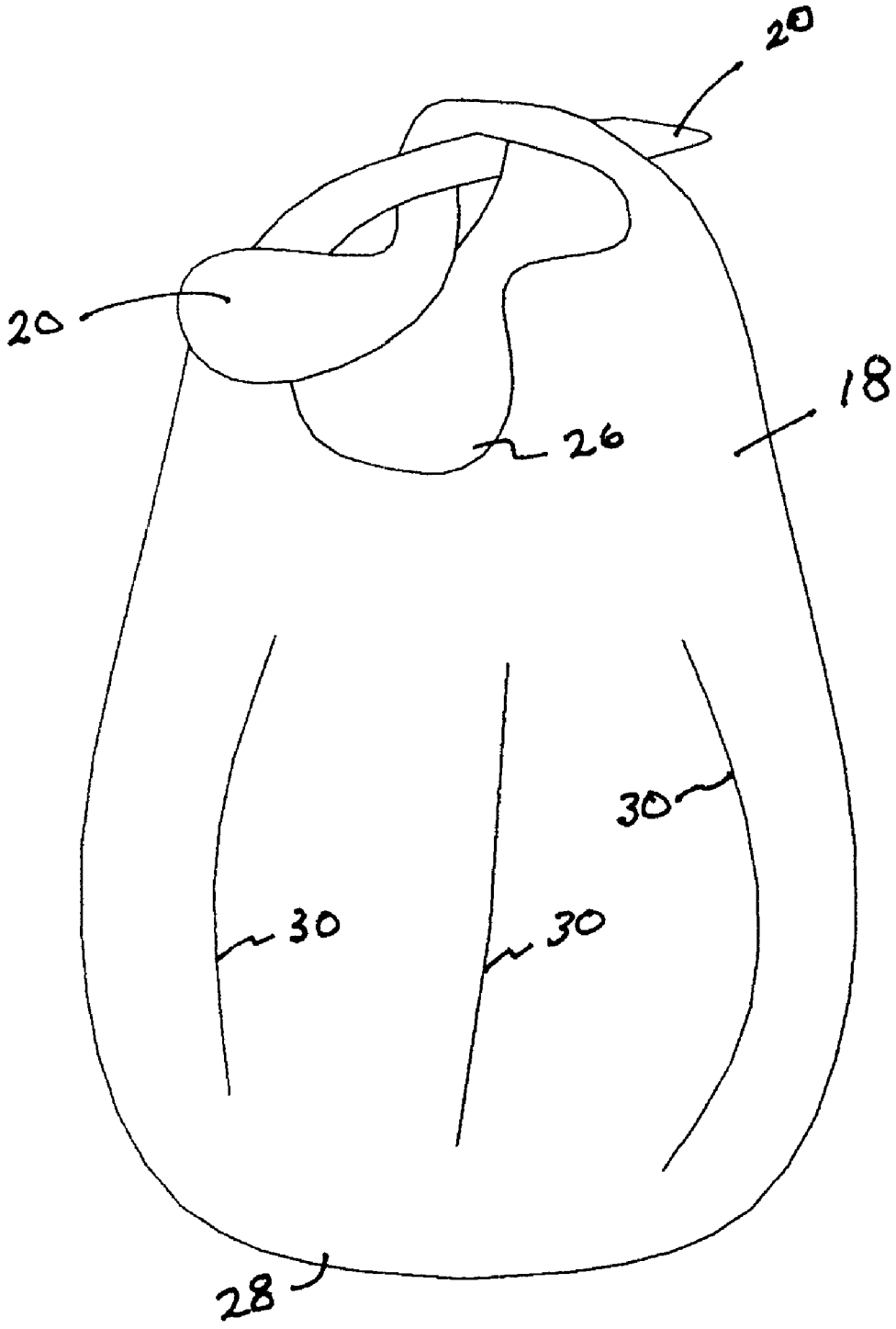
FIG. 4 is a perspective view of a bag in a partially closed configuration removed from the liner apparatus base.

Each bag 18 includes a pair of oppositely disposed tabs 20 integrally connected to a peripheral edge thereof and extending radially outwardly therefrom (FIG. 2). The tabs 20 are constructed of the same material as the bag itself. The tip 22 of each tab 20 is fixedly attached to the tip of an immediately adjacent tab tip with the bottom-most tip being fixedly attached to a respective base flange 16. Each tab 20 further includes a perforation 24 between a respective tip 22 and the rest of the tab 20 (FIG. 3). Therefore, a top-most bag may be torn away from respective tips 22 along the perforation 24 such that the tabs 20 may be tied together to prevent spillage prior to disposal (FIG. 4). It is understood that the peripheral edges of the plurality of liner bags 18 may be coated with an adhesive so as to maintain the stacked relationship until a top-most bag is torn away from the remaining bags. It should also be appreciated that it would be suitable for the base 12 to include only a single flange and each bag to include only a single tab.

Each bag 18 includes an upper edge that defines an open top 26. It is the upper edges that may optionally be adhered to one another with an adhesive. Each bag 18 further includes a closed bottom 28 adapted to extend downwardly through the central opening of the base 12. Therefore, the plurality of compressed bags 18 extend through the central opening of the base and through the conventional opening of a toilet seat or potty seat when in use thereon. Preferably, each bag 18 includes a pleated construction 30 to facilitate expansion thereof as waste is collected and absorbed (FIG. 2), as to described more fully below.

Figure 5:
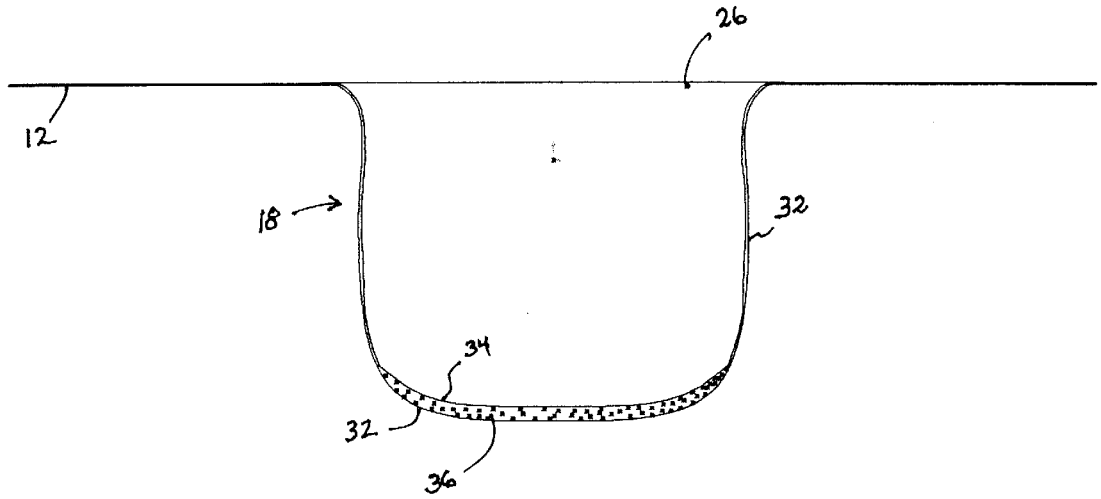
FIG. 5 is a sectional view taken along line 5—5 of FIG. 3.

As shown in FIG. 5, the general bag construction provides an impervious outer layer 32 such that liquid collected therein may not leak through the bag. Each bag 18 further includes a permeable layer 34 extending substantially across the bottom of the interior of the bag. The permeable layer 34 allows liquid waste to be collected in a space between the permeable and impermeable layers. The space between the permeable and impermeable layers includes an absorbent layer 36 having crystalline sodium polyacrylate sandwiched between layers of absorbent cellulose fibrous material. It is understood that other absorbent materials may also surround the sodium polyacrylate, such as lignin, paper, other wood products of high loft and low density, or air-laid pads having short fibers. Sodium polyacrylate is a long-chain molecule that is also a salt. The molecular array functions as a semi-permeable membrane which can soak up to 800 times its weight in water.

In use, the base 12 of the liner apparatus 10 may be positioned on a conventional toilet seat or on the seat of a toddler potty chair 8 (FIG. 1). The bottom portions of the plurality of stacked liner bags 18 extend downwardly through the central opening of the base 12 and through the opening of the toilet seat. Following use, a user may grasp one or both tabs 20 of the top-most bag 18 and tear it away from the remaining bags along respective perforations 24. The tabs 20 may be tied in a knot to prevent spillage and the used bag may be disposed of. When one bag 18 has been torn away, the next bag is already in position for use.

Accordingly, the liner apparatus 10 according to the present invention provides liners that are convenient to use and which automatically leaves another liner in position for the next use. The present invention also provides an improved absorbent layer and an expandable configuration for maximum absorption of waste.

Having thus described the invention, what is claimed as new and desired to be secured by Letters Patent is as follows:

1. A liner apparatus for use with a toilet seat, comprising:

a semi-rigid base having a generally annular configuration complementary to a configuration of a toilet seat and adapted to rest atop the toilet seat and defining a central opening, said base having at least one flange extending radially outwardly therefrom;

a plurality of bags comprised one atop another and positioned upon said base, each bag having a closed bottom adapted to extend through said central opening and having an upper edge defining an open top, each bag including at least one tab attached to said upper edge and removably coupled to said at least one flange, each tab adapted to be grasped by a user for selectably detaching a respective bag from said plurality of bags;

wherein each bag includes a permeable inner layer, an impervious outer layer, and an absorbent layer between said inner and outer layers, said absorbent layer including sodium polyacrylate crystals sandwiched between two layers of absorbent cellulosic fibrous material; and wherein each tab includes a perforated construction adapted to be grasped by a user for tearing a respective bag from said plurality of bags.

2. The liner apparatus as in claim 1 wherein each bag includes a pleated construction between said upper edge and said closed bottom whereby each bag is adapted to expand as a respective absorbent layer absorbs liquid waste.

3. A liner apparatus for use with a toilet seat, comprising:

a semi-rigid base having a generally annular configuration complementary to a configuration of a toilet seat and adapted to rest atop the toilet seat, said base defining a central opening and having at least one flange extending radially outwardly therefrom;

a plurality of flexible bags compressed one atop another and positioned upon said base, each bag having a closed bottom adapted to extend through said central opening and having an upper edge defining an open top, each bag including at least one tab attached to said upper edge and removably coupled to a respective flange, each tab adapted to be grasped by a user for selectably removing a respective bag from said plurality of bags;

wherein each bag includes an impious outer layer, and an absorbent layer between said inner and outer layers, said absorbent layer including sodium polyacrylate crystals sandwiched between two layers of absorbent cellulosic fibrous material;

wherein a peripheral edge of each bag includes an adhesive coating for maintaining a stacked configuration of said plurality of bags during use; and wherein each tab includes a perforated construction adapted to be grasped by a user for tearing a respective bag from said plurality of bags.

4. The liner apparatus as in claim 3 wherein each bag includes a pleated construction between said upper edge and said closed bottom whereby each bag is adapted to expand as a respective absorbent layer absorbs liquid waste.

* * * * *

UNITED STATES PATENT AND TRADEMARK OFFICE

CERTIFICATE OF CORRECTION

PATENT NO. : 6,523,187 B1 
DATED : February 25, 2003
INVENTOR(S) : Kevin R. Brink and Rosa Brink It is certified that error appears in the above-identified patent and that said Letters Patent is hereby corrected as shown below:

Title page,
Replace the informal drawing with the formal illustrative drawing of Fig. 1.

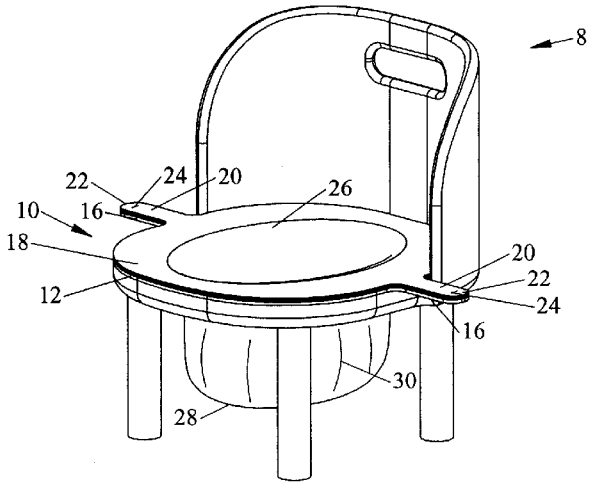

FIG. 1

Drawings,
Sheet 1 of 4, replace the formal drawing of Fig 1. with the formal drawing of Fig. 1.

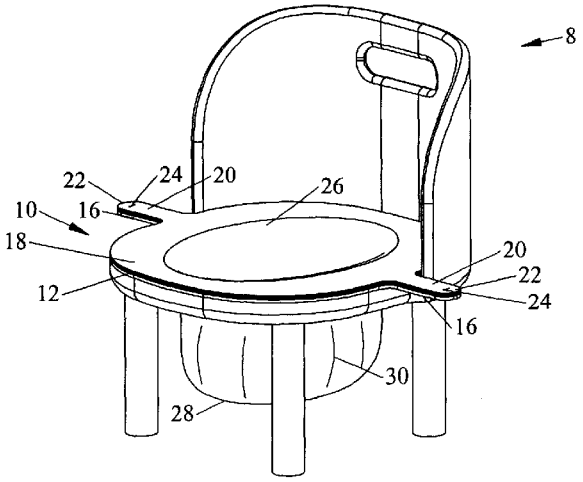

FIG. 1

UNITED STATES PATENT AND TRADEMARK OFFICE

CERTIFICATE OF CORRECTION

PATENT NO. : 6,523,187 B1 
DATED : February 25, 2003
INVENTOR(S) : Kevin R. Brink and Rosa Brink It is certified that error appears in the above-identified patent and that said Letters Patent is hereby corrected as shown below:

Drawings, (cont.)

Sheet 2 of 4, replace the formal drawing of Fig 2. with the formal drawing of Fig. 2.

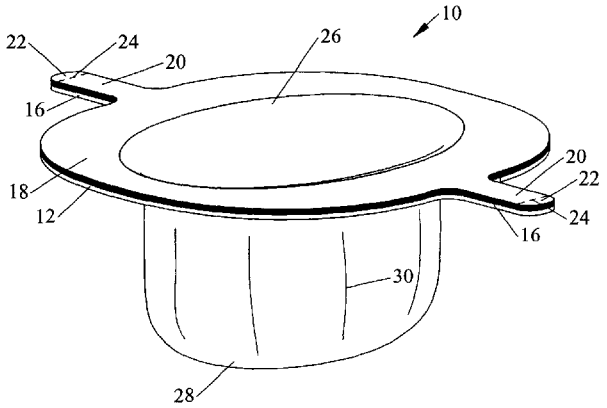

FIG. 2

Sheet 3 of 4, replace the formal drawing of Fig 3. And Fig 5. with the formal drawings of Fig. 3 and Fig. 5.

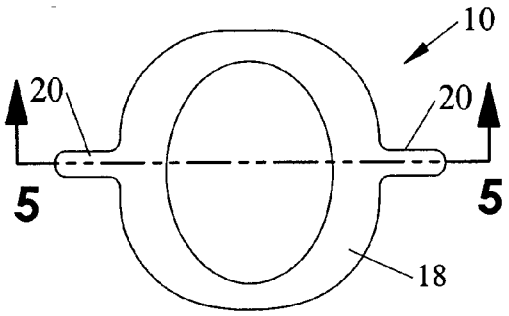

FIG. 3

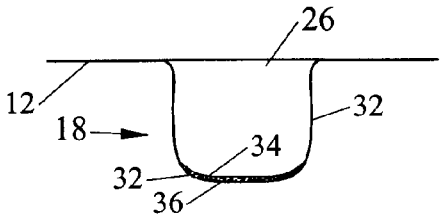

FIG. 5

UNITED STATES PATENT AND TRADEMARK OFFICE

CERTIFICATE OF CORRECTION

PATENT NO. : 6,523,187 B1 
DATED : February 25, 2003
INVENTOR(S) : Kevin R. Brink and Rosa Brink It is certified that error appears in the above-identified patent and that said Letters Patent is hereby corrected as shown below:

Drawings, (cont.)
Sheet 4 of 4, replace the informal drawing of Fig 4. with the formal drawings of Fig. 4.

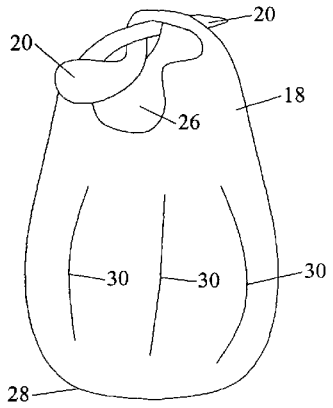

FIG. 4

Signed and Sealed this

Seventeenth Day of June, 2003

JAMES E. ROGAN
*Director of the United States Patent and Trademark Office*